United States Patent [19]

Lamb

[11] 4,258,481

[45] Mar. 31, 1981

[54] BOOT

[76] Inventor: Charles C. T. Lamb, 33 Walker Rd., Willowdale, Ontario M2N 2K2, Canada

[21] Appl. No.: 48,708

[22] Filed: Jun. 15, 1979

[51] Int. Cl.[3] ..... A43B 5/04; A43B 3/26

[52] U.S. Cl. ..... 36/120; 36/97

[58] Field of Search ..... 36/117, 118, 119, 120, 36/97, 99

[56] References Cited

U.S. PATENT DOCUMENTS

| | | | |
|---|---|---|---|
| 3,824,713 | 7/1974 | Vaccari | 36/118 |
| 3,939,582 | 2/1976 | Garbuio | 36/117 |
| 4,008,532 | 2/1977 | Kilbourn et al. | 36/120 |

*Primary Examiner*—Patrick D. Lawson

*Attorney, Agent, or Firm*—James T. Wilbur

[57] ABSTRACT

The boot includes a heel portion which together with a sole and vamp define a space for accommodation of a wearer's foot. A stiff inner upper is integrally connected to the vamp and heel portion and a stiff outer upper surrounds the inner upper. The outer upper is connected to the inner upper at the rear of the boot only and is free to move in the forward and rearward direction relative to the inner upper but is substantially immovable relative to the inner upper in the lateral direction.

6 Claims, 6 Drawing Figures

BOOT

BACKGROUND OF THE INVENTION

This invention relates to footwear and more particularly to a boot which securely holds the wearer's foot against the sole and supports the ankle against lateral movement while allowing substantially unhindered forward and rearward flexure of the lower leg.

It is important that the feet of skiers be held in such a way that lateral movement of their ankles is severely restricted while forward and rearward flexure is permitted. For example, proper edge control of skiers requires that the ski boot hold the skier's ankles rigid in the lateral direction. On the other hand, it is necessary for a skier to be able to flex his ankle forwardly and rearwardly so that he can appropriately shift his weight for turning and properly keep his body level when travelling over moguls or other uneven surfaces.

To provide the desired lateral support for the wearer's ankle, most ski boots are provided with a stiffened upper portion which extends above the wearer's ankle and which may be tightened about the wearer's lower leg. The upper portion is pivotally connected to the lower portion of the boot adjacent the wearer's ankle bone and thereby permits forward and rearward flexure of the lower leg with respect to the foot but prevents or severely restricts lateral movement of the lower leg.

Usually the upper and lower portions of known ski boots are pivotally interconnected by means of a rivet or a hinge. Such an attachment means is unsatisfactory for a number of reasons. First, the cost of the rivet or hinge and the cost of attachment to the upper and lower portions of a boot are significant elements of the overall cost of the finished boot. Secondly, the rivet or hinge is fixed in position and cannot move forwardly or rearwardly as the lower leg flexes. To be truly effective, the rivet or hinge should do so with like movement of the pivotal axis of the wearer's ankle as the lower leg flexes. The structure of a rivet or hinge capable of moving with the axis of an ankle is too complicated and expensive of manufacture for adoption by most boot manufacturers.

It is an object of this invention to provide a boot having an upper portion which provides lateral support for a wearer's ankle and which is free to pivot forwardly and rearwardly but is not connected to the lower portion of the boot by a rivet or hinge.

Another object of this invention is to provide a boot having an upper portion in the form of an outer upper disposed about and integral with an inner upper. Both inner and outer uppers are formed of stiff material which permits pivotal movement of the outer upper relative to the inner upper at the point at which the two uppers are interconnected but which resists relative movement at other points.

A still further object of this invention is to provide a boot having means for selectively increasing or decreasing the size of the interior space for accommodation of feet of different sizes.

These and other objects are accomplished by a boot comprising a sole; a vamp; a heel portion which together with the sole and vamp define a space for accommodation of a wearer's foot; a stiff inner upper connected to the vamp and heel portion and covering the lower areas of the wearer's calf and shin; and an outer upper disposed about said inner upper and connected thereto at the rear but unconnected thereto at the front and sides such that the outer upper is free to move in the forward and rearward direction relative to the inner upper but is substantially immovable relative to the inner upper in the lateral direction.

The invention is described below with reference to the accompanying drawings in which.

Like reference characters refer to like parts throughout the description of the drawings.

Figure 1:
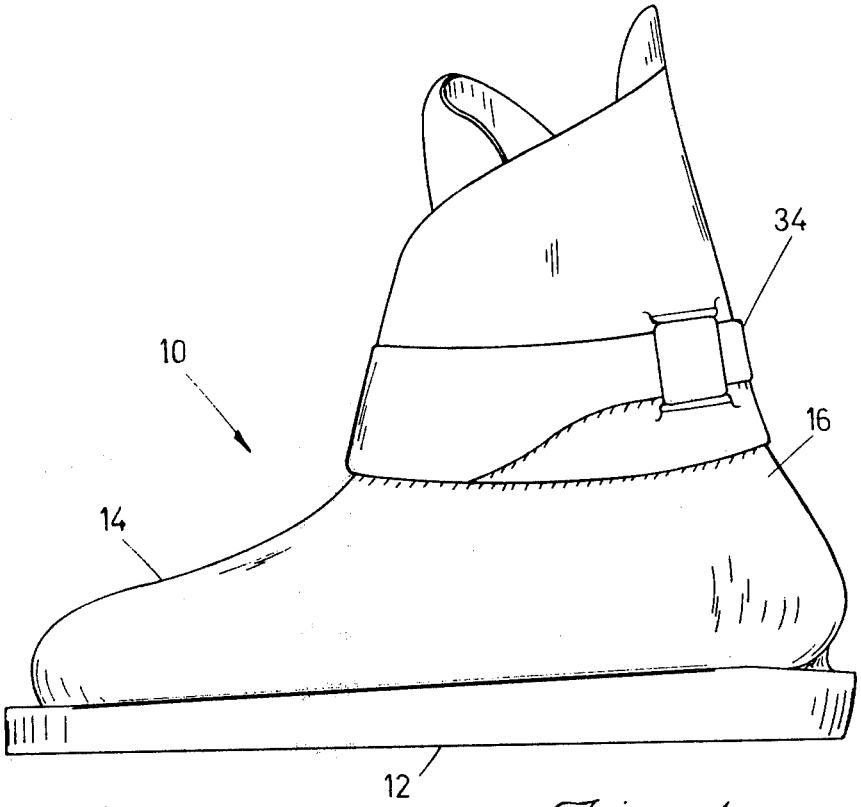
FIG. 1 is a side elevation of the boot of the invention.
Figure 2:
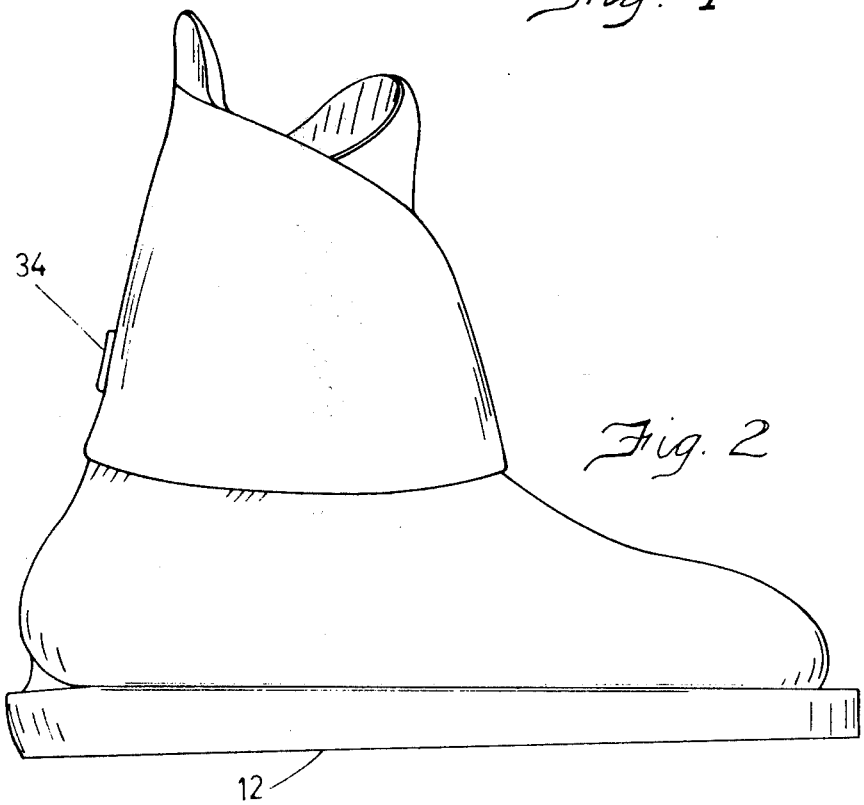
FIG. 2 is an elevation of the side of the boot opposite that shown in FIG. 1.
Figure 3:
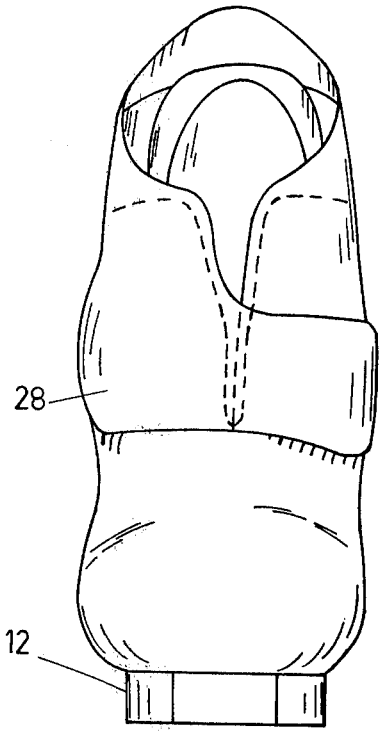
FIG. 3 is a front elevation of the boot.
Figure 4:
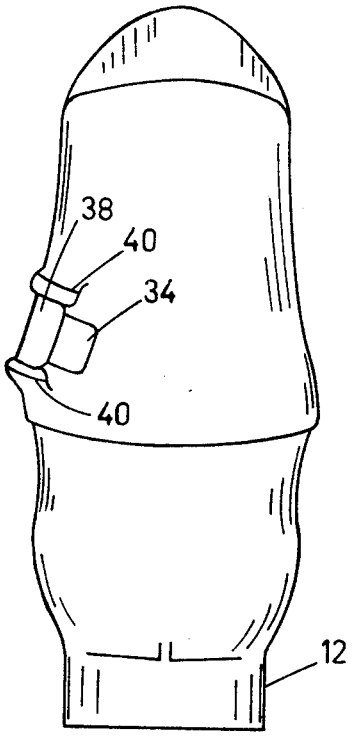
FIG. 4 is a rear elevation of the boot.
Figure 5:
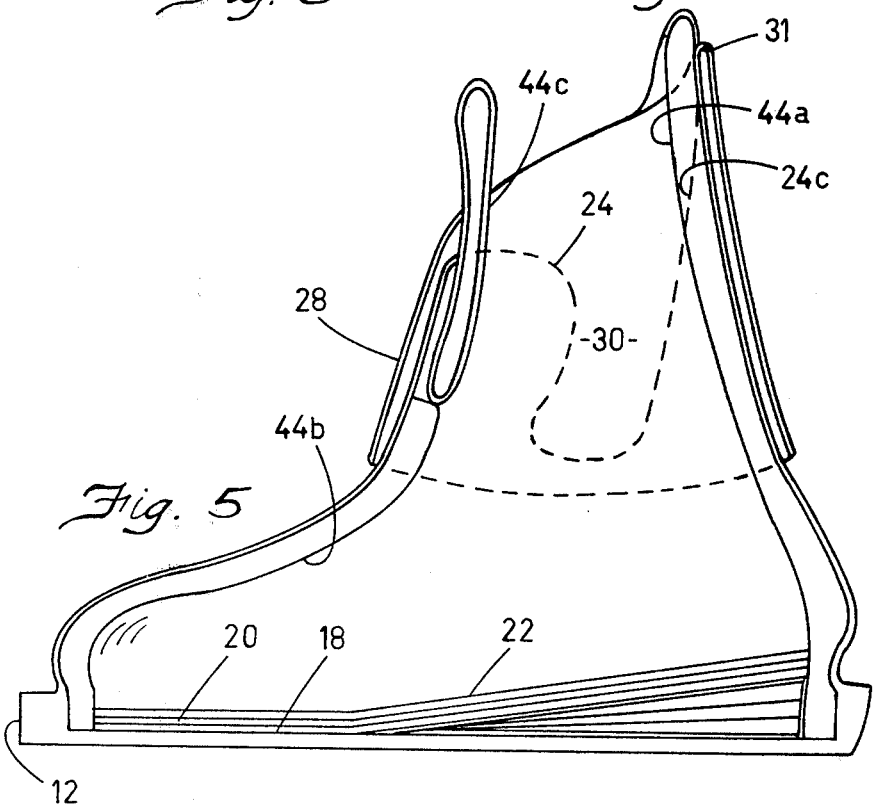
FIG. 5 is a section of the boot.

With reference first to FIGS. 1 and 5, the boot of the invention, indicated generally by the numeral 10, includes an inflexible sole 12, a vamp 14 and a heel portion 16. The sole includes, as depicted in the broken away portion of the latter Figure, an outer sole 18 and an inner sole 20. To assure that the sole 12 is inflexible, outer sole 18 should be of a stiff, inflexible material such as a hard plastic whereas inner sole 20 can be of foam rubber or other soft material.

An auxiliary sole 22 is disposed above inner sole 20. The auxiliary sole is provided not only for the wearer's comfort but to permit limited adjustment of the interior space of the boot. The sole consists of a number of layers of material and each layer is removable for selectively increasing the size of the interior space to accommodate feet of increasing sizes.

Vamp 14 conforms generally to the shape of the wearer's foot and is preferably composed of a rigid or semi-rigid molded plastic material such as thermoplastic. The latter material is especially preferred since it can be heated and its shape altered should the vamp cause discomfort to the foot of the wearer. The vamp will act to hold the front part of the foot immovable and while the vamp can be custom made for the foot of the individual wearer, it is not necessary that it be so. The vamp in fact can be mass produced in regular sizes and appropriate padding placed therein to conform the interior space to the shape of the wearer's foot.

Heel portion 16 likewise is of a rigid or semi-rigid material such as plastic and preferably is molded to conform to the shape of the individual wearer's heel. The heel portion and vamp are preferably composed of a single piece so that movement of one relative to the other is avoided.

Figure 6:
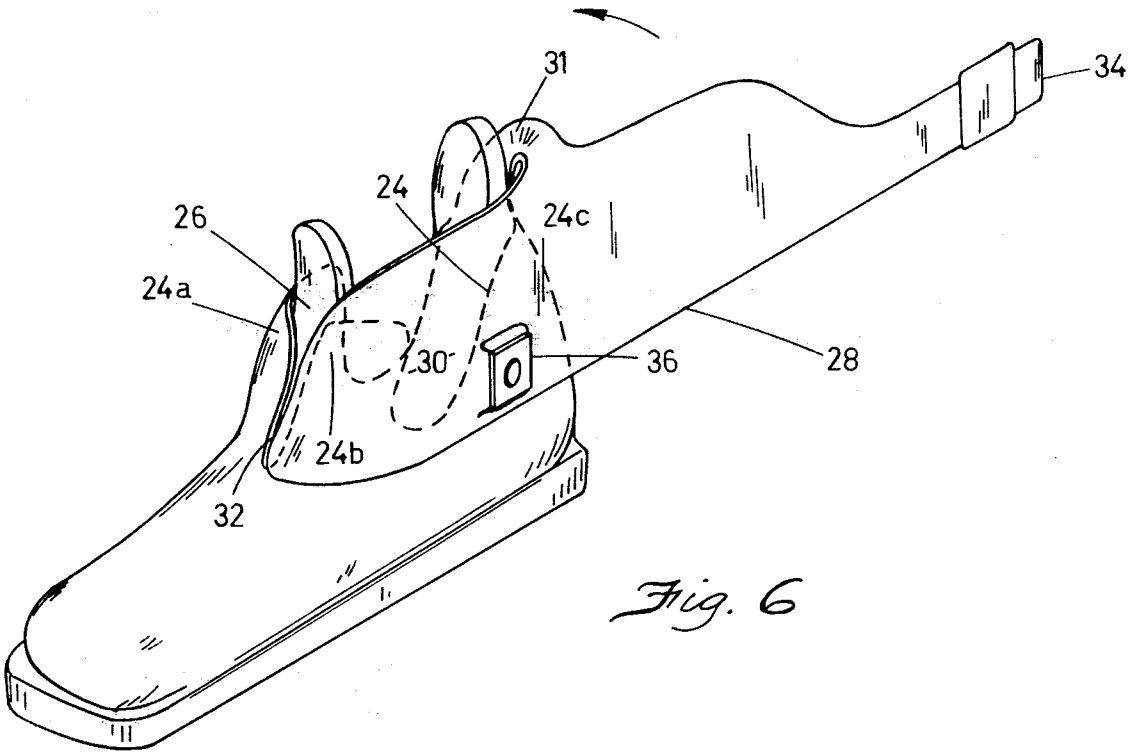
FIG. 6 is a perspective view of the boot in an open position.

As depicted in FIGS. 5 and 6, an inner upper 24 is integral with and extends upwardly from the vamp and heel portion. The upper is similarly composed of rigid or semi-rigid material and is provided with a forward portion having a pair of upwardly extending tabs 24*a,b* separated by a space 26 at the front of the boot. The rear portion 24*c* of the upper extends upwardly above tabs 24*a,b* and terminates at an upper edge which is approximately at the level of the lower region of the wearer's calf. The rear upper portion 24*c* is separated from tabs 24*a,b* by a space 30 for accommodation of the wearer's ankle bones.

An outer upper 28 surrounds and is adjacent the inner upper. The outer upper consists of an elongated strip of material which is sufficiently stiff or rigid to support the lower leg but which is somewhat flexible to allow the leg to move slightly in the boot. Plastic material is preferred for this purpose. The strip which forms the outer upper is of varying width and commences at a first end 32 disposed at but unconnected to the front of the boot. The strip extends about a side of the boot and to the back where it is connected by a tab 31 to the inner upper 24. The strip then extends about the other side of the boot to the front and is double-backed upon itself at the first-mentioned side and terminates at a second end 34. Means is provided for interconnecting the two portions of the outer upper 28 adjacent the first-mentioned side. Such means may be in the form of a conventional ratchet fastener or male and female elements 36,38 respectively of a dome fastener as illustrated. Alternatively, the two portions of the strip may be connected by "Velcro". Whatever means is employed, it is preferable that it be adjustable so that the outer upper can be tightened or loosened about the wearer's leg to selectively decrease or increase the amount of permitted forward and rearward movement of the leg in the boot.

Ridges 40 are molded into the outer upper above and below the fastening means to protect it from external blows. Connected to the back of the outer upper and to the rear portion 24*c* of the inner upper adjacent its upper edge is tab 31 mentioned previously. The tab may be glued, riveted or stitched to the uppers or it may be integrally connected to one or the other. The tab serves as the only interconnecting means between the inner and outer uppers. Specifically, the uppers are connected only at the back and are not connected at the sides and front of the boot. The outer upper is thus free to pivot in the forward and rearward direction but is free to pivot in the lateral direction only slightly or not at all owing to its inherent stiffness and to the stiffness of the underlying inner upper.

With reference to FIG. 5, the interior of the boot is provided with a plurality of flexible pads 44. One pad, indicated by the numeral 44*a*, extends upwardly at the rear of the boot and terminates above the upper edge of the inner upper 24. A second pad 44*b* is disposed within the vamp and extends about the side, front and instep of the wearer's feet. A third pad 44*c* is disposed within the inner upper and contacts the lower area of the wearer's shin.

It will be understood, of course, that modifications can be made in the preferred embodiments of the invention described and illustrated herein without departing from the scope and purview of the invention as defined in the appended claims.

What I claim as new and desire to protect by Letters Patent of the United States is:

1. A boot comprising: a sole; a vamp, a heel portion which together with the sole and vamp define a space for accommodation of a wearer's foot; an inner upper which is connected to the vamp and heel portion and which extends upwardly above the wearer's ankle to cover the lower areas of the wearer's calf and shin; and an outer upper disposed about said inner upper and having an upper edge which is connected to an upper edge of said inner upper at the rear thereof, said outer upper being otherwise unconnected to said inner upper such that the outer upper may pivot freely about the connection at the upper edge thereof in the forward and rearward direction relative to the inner upper.

2. A boot comprising: a sole; a vamp, a heel portion which together with the sole and vamp define a space for accommodation of a wearer's foot; a stiff inner upper which is connected to the vamp and heel portion and which extends upwardly above the wearer's ankle to cover the lower areas of the wearer's calf and shin; and a supportive but slightly flexible outer upper disposed about said inner upper and having an upper edge which is connected to an upper edge of said inner upper at the rear thereof, said outer upper being otherwise unconnected to said inner upper such that the outer upper may pivot freely about the connection at the upper edge thereof in the forward and rearward direction relative to the inner upper.

3. A boot comprising: a sole; a vamp, a heel portion which together with the sole and vamp define a space for accommodation of a wearer's foot; an inner upper which is connected to the vamp and heel portion and extending about the lower area of the wearer's leg except for the front thereof; and an outer upper disposed about said inner upper and having an upper edge which is connected to an upper edge of said inner upper at the rear thereof, said outer upper being otherwise unconnected to said inner upper such that the outer upper may pivot freely about the connection at the upper edge thereof in the forward and rearward direction relative to the inner upper.

4. The boot as claimed in claim 1 wherein said outer upper includes an elongated strip which commences at a first end disposed at the front of the boot, extends about a side and to the back at which its upper edge is connected to the upper edge of the inner upper, thence extends about the other side of the boot to the front and overlaps the first-mentioned side and terminates at a second end such that the outer upper is free to move in the forward and rearward direction relative to the inner upper but is substantially immovable relative to the inner upper in the lateral direction; said boot further including means for detachably connecting the outer upper adjacent said second end to the area of the outer upper disposed adjacent thereto.

5. The boot as claimed in claim 1, wherein said outer upper includes an elongated strip which commences at a first end disposed at the front of the boot, extends about a side and to the back at which it is connected to the inner upper, thence extends about the other side of the boot to the front and overlaps the first-mentioned side and terminates at a second end such that the outer upper is free to move in the forward and rearward direction relative to the inner upper but is substantially immovable relative to the inner upper in the lateral direction; said boot further including means for detachably connecting the outer upper adjacent said second end to the area of the outer upper disposed adjacent thereto, said connecting means being adjustable to selectively decrease or increase the amount of permitted forward and rearward movement of the wearer's leg in the boot.

6. A sport boot as claimed in calim 1, further including an auxiliary sole disposed within said boot and comprising a plurality of layers removable for selectively increasing the size of said space for accommodation of feet of increasing sizes.

* * * * *